United States Patent [19]

Scott et al.

[11] 4,211,360

[45] Jul. 8, 1980

[54] OPENABLE CONTAINER COVER (III)

[75] Inventors: Raymond G. Scott, Oak Brook; Lawrence S. Wysocki, Chicago, both of Ill.

[73] Assignee: Champion International Corporation, Stamford, Conn.

[21] Appl. No.: 972,510

[22] Filed: Dec. 22, 1978

[51] Int. Cl.[2] ..... B65D 5/64; B65D 47/04

[52] U.S. Cl. ..... 229/43; 206/612; 206/628; 229/3.5 MF

[58] Field of Search ..... 229/43, 3.5 MF; 206/628, 612

[56] References Cited

U.S. PATENT DOCUMENTS

| | | | |
|---|---|---|---|
| 3,004,697 | 10/1961 | Stone | 206/628 X |
| 3,047,144 | 7/1962 | Wissel | 206/813 X |
| 3,144,194 | 8/1964 | Cartwright | 206/628 |
| 3,183,800 | 5/1965 | Farrell et al. | 206/628 X |
| 3,244,356 | 4/1966 | Wolowicz et al. | 229/43 |
| 3,270,941 | 9/1966 | Barnes | 206/628 X |
| 3,391,852 | 7/1968 | Waldrop | 206/628 X |

*Primary Examiner*—Stephen P. Garbe

*Attorney, Agent, or Firm*—Evelyn M. Sommer

[57] ABSTRACT

A paperboard cover adapted for being marginally secured to a popcorn container comprises circular and semicircular cut scores defining a lift tongue therebetween. The end part of the lift tongue is provided with an easy lift tab and communicates with a cutout area. The cutout area is covered by an easy lift protective flat piece that at least partially is glued to a surface portion of the cover.

3 Claims, 4 Drawing Figures

OPENABLE CONTAINER COVER (III)

BACKGROUND OF THE INVENTION

This invention relates generally to protective covers for prepackaged foods and more particularly it relates to an openable cover adapted to be used in connection with an aluminum pan in which raw corn kernels are popped.

The packaging of foods in metal containers in which they must be heated for serving is a widespread practice. Among the food products packaged in this manner is raw corn kernels for making popped corn. Such packages contain dried corn kernels and cooking oil as well as salt, other flavoring agents and preservatives. The container is covered with an extensible aluminum foil and is provided with a handle. In the heating process, the pan is placed over a source of heat and the corn is popped within the pan causing expansion of the extensible cover.

The aluminum foil used in such a cover is of extremely thin guage, considerably thinner than the aluminum used for the bottom or sides of the pan. Owing to its thinness, the aluminum foil in the cover is susceptible to damage or perforations. It is therefore necessary to employ an additional cover over the top of the pan when it is offered for sale and the additional cover must be easily openable. Generally a paperboard cover is used and in addition to serving the protective function, it also permits display of advertising matter and identification of the product as well as directions for use. The paperboard cover is anchored in a sealed relation on the container by crimping a margin of the aluminum foil on both of the expansible top and relatively thick container sides.

Prior to heating the popped corn package, a major central part of the paperboard cover must be removed in order to permit the expansible aluminum top to expand through a remaining annular portion of the paperboard cover during the heating. This annular portion of the paperboard cover acts as a gasket for the pan and the thin expandable foil to reduce the loss of steam during popping thus causing the package to function successfully.

To facilitate the removal of the cover, one or more top scores extend on both surfaces of the cover around the peripheral portion thereof. The depth of the top scores is usually less than the depth of the paperboard cover. In order to define a finger tab there has been provided an angular cut or tab terminating in the outer peripheral cut score. When the finger tab is gripped and pulled, the paperboard cover is torn away along the cut score lines thereby exposing the expansible aluminum foil top and leaving, around the rim of the container, a narrow marginal band of paperboard.

A paperboard container cover that is provided with cut scores and an angular cut so as to facilitate easy removal of a major portion thereof, as described hereinabove, is disclosed in U.S. Pat. Nos. 3,043,680 and 3,110,233.

Openable paperboard covers disclosed in the above patents have been used for several years in connection with the popped corn producing containers. The angular cut shape defining a finger tab which acts as a starter for the lid opening and removal of the same has been used because it helps minimize the moisture vapor transmission and helps prevent accidental puncturing of the spun aluminum located underneath. Prior to using the angular cut shape, other die cut shapes were used; however, these proved faulty for one reason or another. Due to the fact that the angular cut or pull tab is normally in the plane of the upper surface of the lid, it has been necessary first to lift the sides of the angular tab. The delicate spun aluminum foil has been frequently punctured by a fingernail or other object when the lid opening process has been started. A small protective circular tab has been placed underneath the area of the angular cut but despite this precaution the above-mentioned probelm has still taken place.

It is therefore a primary object of this invention to provide a paperboard cover for prepackaged foods container which at the start of opening operation substantially reduces the danger of puncturing the underlying aluminum foil of the container.

Another object of this invention is to make the lid opening and removal easier.

SUMMARY OF THE INVENTION

In keeping with this and other objects which will become apparent hereinafter, one feature of this invention resides in providing an opening in the cover near the starting end of a lift tongue and an easy to lift tab in tandem with the free end of the lift tongue. This tab is made by a short cut score line extending a small distance from and parallel to the free end of the lift tongue and by two short through cuts in a circular and semicircular top scores between the opening and the short cut score line on the lift tongue. A protective tab is applied over the opening either by by folding a circular satellite tab over the cover and partially glueing this tab to the top surface portion or by applying an easy-to-lift pressure sensitive adhesive label or tape on the upper surface to span the opening. This protective tab or adhesive label does not assist in the opening of the inner part of the cover and after its removal the user starts the opening process by lifting up the tab at the end of the lift tongue.

The novel features which are considered as characteristic for the invention are set forth in the appended claims. The invention itself, however, together with additional objects and advantages thereof, will be best understood from the following description of specific embodiments when read in connection with the accompanying drawings.

DESCRIPTION OF THE PREFERRED EMBODIMENTS

Figure 1:
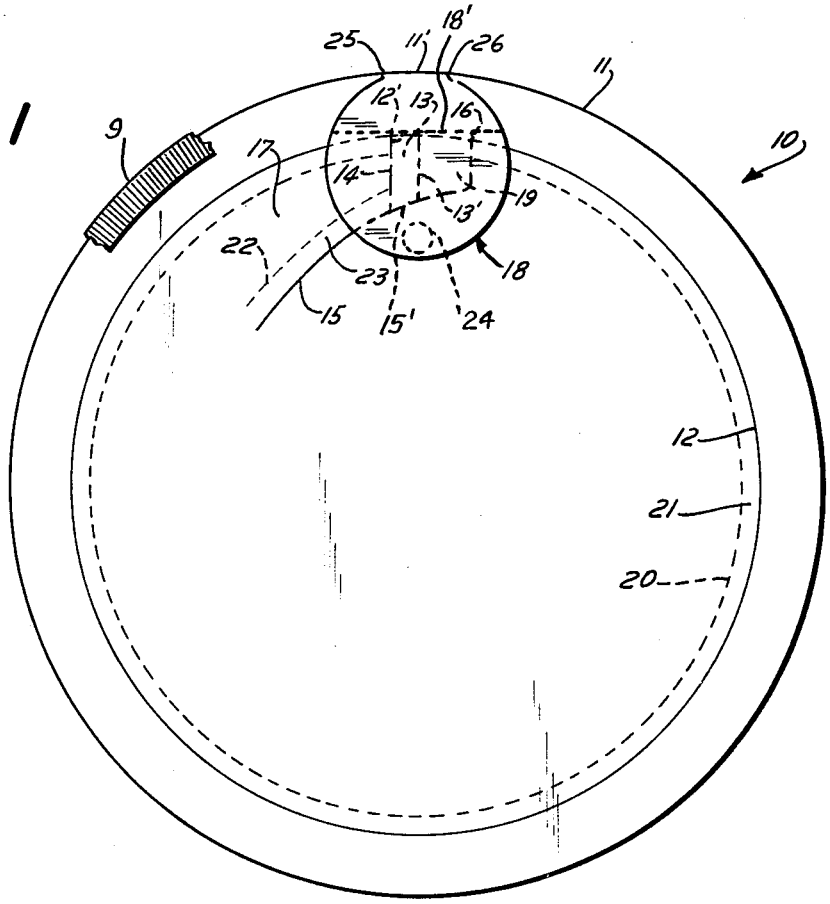
FIG. 1 is a top view of one embodiment of this invention employing a protective tab folded over the cover.
Figure 2:
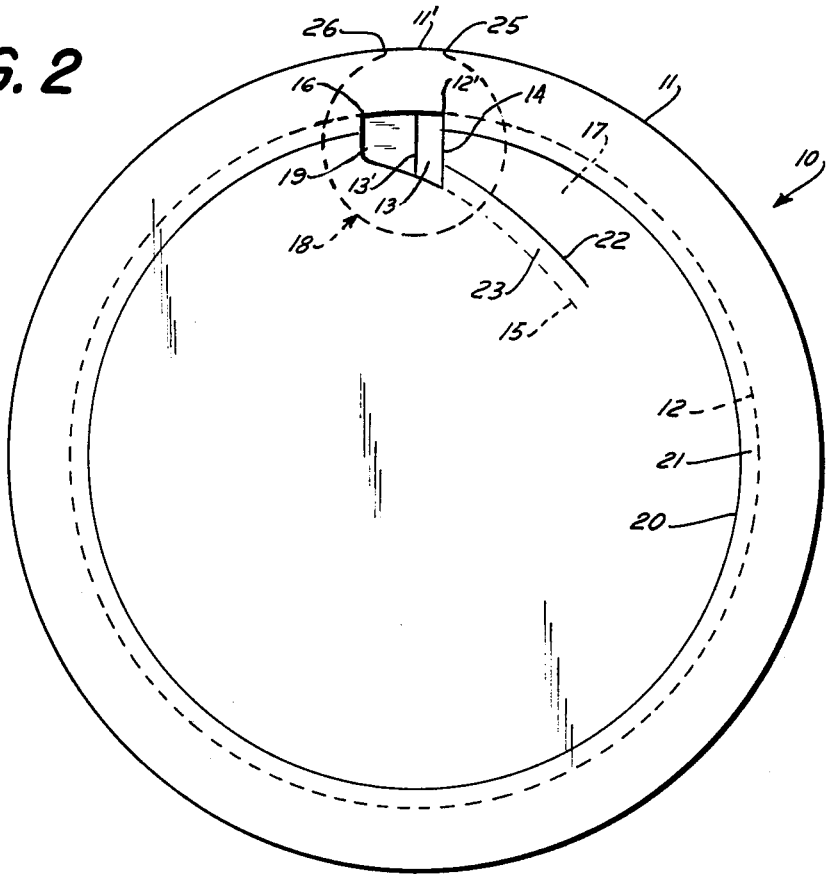
FIG. 2 is a bottom view of the cover of FIG. 1.

Container cover 10 shown in the drawing is designed to be crimped along its peripheral edge 11 by the sides of an aluminum pan and an expansible aluminum top foil 9 indicated in a fragmentary view. The upper surface of the cover 10 is provided with a continuous outer cut score line 12 which is spaced from the outer edge 11 of the cover. A second cut score line 15 is formed on the upper surface of the cover in a spaced relation to cut score line 12. Cut score line 15 diverges from the cut score line 12 and extends across only a relatively small portion of cover 10 defining a tongue like area 17. A cutout area 19 of a size suitable to accommodate the tip of the finger of a user bridges the narrow part of the tongue 17 and defines a free edge 13' of the tongue. An easy to lift pull tab 13 is created at the starting end of the tongue 17 by providing a transverse cut score 14 at a short distance from and parallel to the free edge 13' and short throughcuts 12' and 15' in cut scores 12 and 15. The bottom surface of cover 10 is provided with a continuous cut score line 20 conforming in shape to and being uniformly spaced inwardly from cut score line 12. A second cut score line 22 on the lower surface is uniformly spaced inwardly from cut score line 15 and both cut score lines 20 and 22 terminate at the lift tab 13. In this manner the cut scores 12 and 20 define a tear ring 21 and the cut scores 15 and 22 define a tear strip 23. Between the tear strip 23 and the opposite section of the ring 21 the aforementioned starting tongue 17 diverges from the cutout area 19 and serves for starting the opening process. Contrary to prior art covers of this type, the user can now without any preparatory manipulation insert his finger into the cutout area 19 and immediately grip the easy to lift tab 13.

Located above the cutout area 19 is a protective circular tab 18 which is initially attached to the outside edge 11 of the cover along a connection line 11' extending between points 25 and 26. The tab 18 is folded along this connection line 11' onto the upper surface of cover 10 and partially glued thereto at 24, thereby covering the cutout area 19 and protecting the underlying aluminum foil of the container. In order to obtain access to cutout 19, tab 18 is simply lifted, and if desired, torn along a perforated score line 18'.

Figure 3:
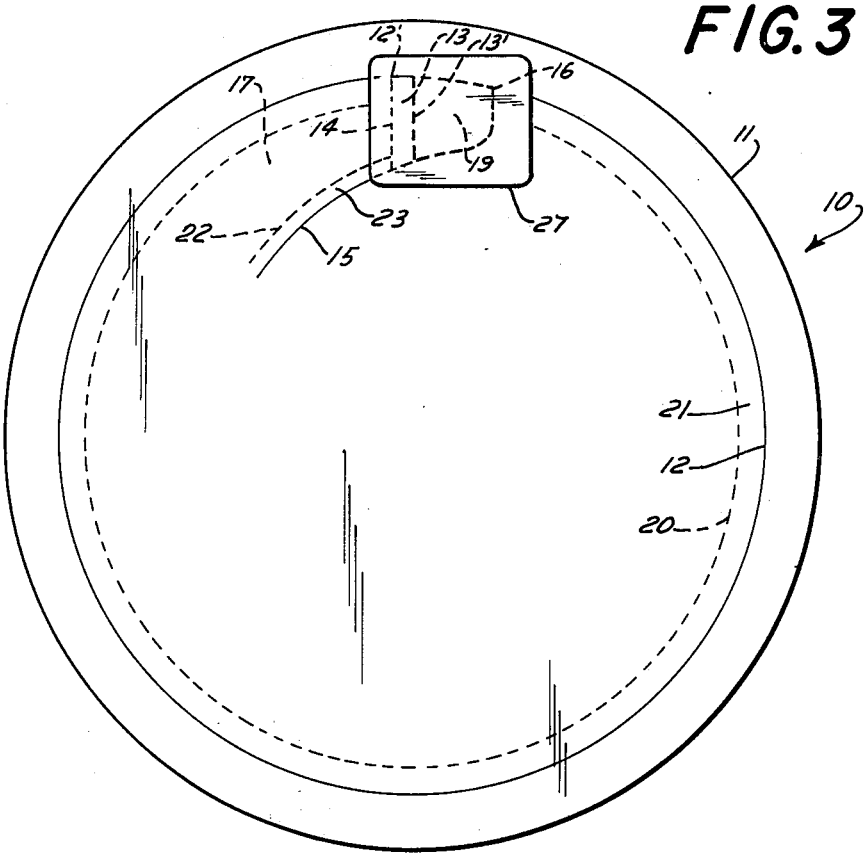
FIG. 3 is a top view of another embodiment of the cover of this invention employing an easy to lift adhesive label to protect the cutout area.
Figure 4:
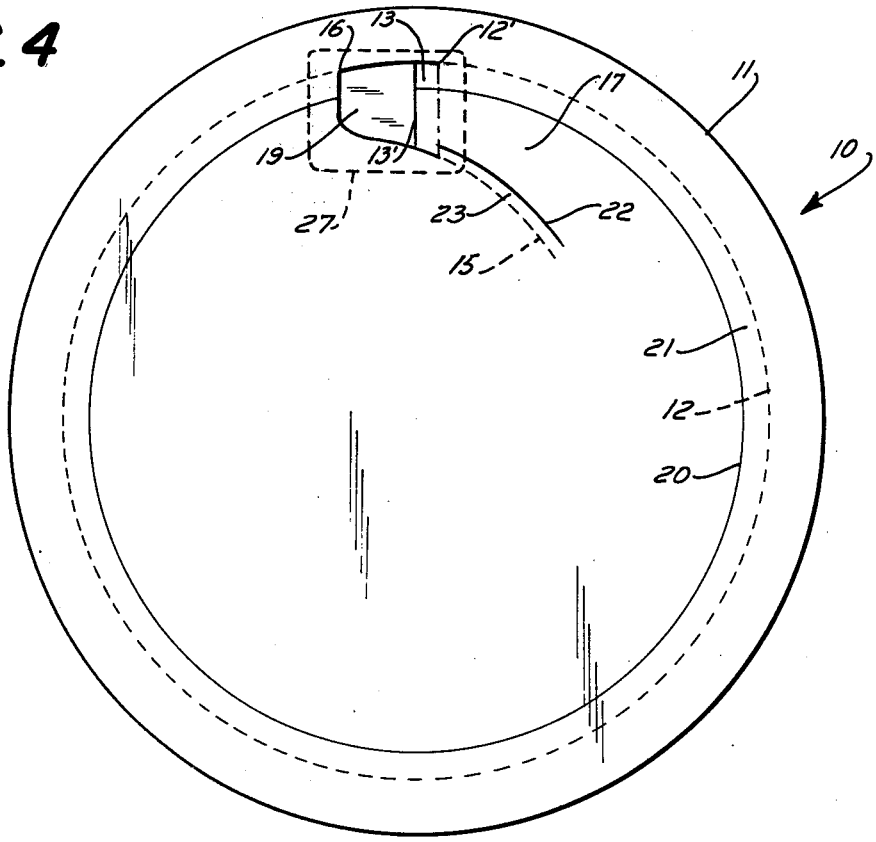
FIG. 4 is a bottom view of the lid of FIG. 3.

In a modification of this invention, as shown in FIGS. 3 and 4, an easy to lift type pressure sensitive adhesive label 27 is applied to the upper surface portion of the cover 10 to cover the lift tab 13 and the cutout area 19. After removal of the easy to lift label 27, the user would start removing the inner portion of the cover 10 in the same manner as in the preceding example.

It will be understood that each of the elements described above or two or more together, may also find a useful application in other types of protective covers differing from the type described above.

What is claimed as new and desired to be protected by Letters Patent is set forth in the appended claims:

1. An openable cover adapted to span and be marginally secured to a container comprising in combination: a substantially flat paperboard sheet having a first cut score on the upper surface thereof, a second cut score on the lower surface thereof, said cut scores extending therearound and being substantially uniformly spaced from each other and from the edge of the sheet, a third cut score spaced inwardly from the first cut score on the upper surface of the sheet, a fourth cut score spaced inwardly from the second cut score on the lower surface of the sheet, said first and third cut scores defining a pull tongue therebetween, the combined depth of the said first and second cut scores and respectively of said third and fourth cut scores being approximately the thickness of the sheet, a cutout area provided between said first and second cut scores to define a free end edge of the pull tongue, a fifth cut score spaced apart from and extending substantially parallel to said free end edge of said pull tongue, two short cuts provided between said end edge and said fifth cut score to define an easy lift tab, and a protective flat piece at least partially glued to a surface portion of the sheet and covering said cutout area and said easy lift tab.

2. A cover as defined in claim 1, wherein said protective piece is a substantially circular paperboard tab partially glued to an upper surface portion of said sheet covering said cutout area.

3. A cover as defined in claim 2, wherein said protective piece is a pressure sensitive tape having any easy release adhesive layer applied on the upper surface of said sheet to cover said cutout area and said easy to lift tab.

* * * * *